United States Patent [19]

Okano et al.

[11] 4,007,561

[45] Feb. 15, 1977

[54] DEVICE FOR AUTOMATICALLY LAPPING VALVE SEAT

[75] Inventors: Masami Okano, Kita-kyushu; Morito Sadamura, Yukuhashi; Muraichi Iwasaki, Kita-kyushu; Takeshi Suzuki, Kita-kyushu; Yasushi Utunomiya, Kita-kyushu; Yoshihiro Yajima, Kita-kyushu; Yozi Yamauchi, Yukuhashi; Yutaka Terawaki, Kita-kyushu, all of Japan

[73] Assignee: Okano Valve Seizo Kabushiki Kaisha

[22] Filed: Sept. 15, 1975

[21] Appl. No.: 613,300

[30] Foreign Application Priority Data

Sept. 17, 1974 Japan ..... 49-106021

[52] U.S. Cl. ..... 51/241 VS; 51/170 PT; 51/34 J

[51] Int. Cl.[2] ..... B24B 9/00; B24B 23/00

[58] Field of Search ..... 51/56, 34 J, 170 R, 51/170 PT, 241 VS, 241 S, 262 R, 263

[56] References Cited

UNITED STATES PATENTS

| | | | |
|---|---|---|---|
| 2,443,489 | 6/1948 | Weynano | 51/241 VS |
| 2,722,785 | 11/1955 | Porter et al. | 51/263 X |
| 3,034,269 | 5/1962 | Bettenhausen | 51/241 VS |

*Primary Examiner*—Al Lawrence Smith
*Assistant Examiner*—James G. Smith
*Attorney, Agent, or Firm*—Amster & Rothstein

[57] ABSTRACT

The disclosed device comprises a supporting disc, a sleeve centrally pendent from the disc, a hollow driven shaft rotatably and axially slidably extending through the disc and sleeve, and a lapping disc fixed to that end of the shaft extending from the sleeve. With the supporting disc disposed upon a valve body including a valve seat to be lapped, the lapping disc can contact the valve seat to fit it during the rotation of the shaft. With the lapping disc raised from the lapped valve seat, a wiper on the disc is actuated to wipe the latter. The seat can be observed through a periscope type observation glass extending through the hollow shaft.

4 Claims, 1 Drawing Figure

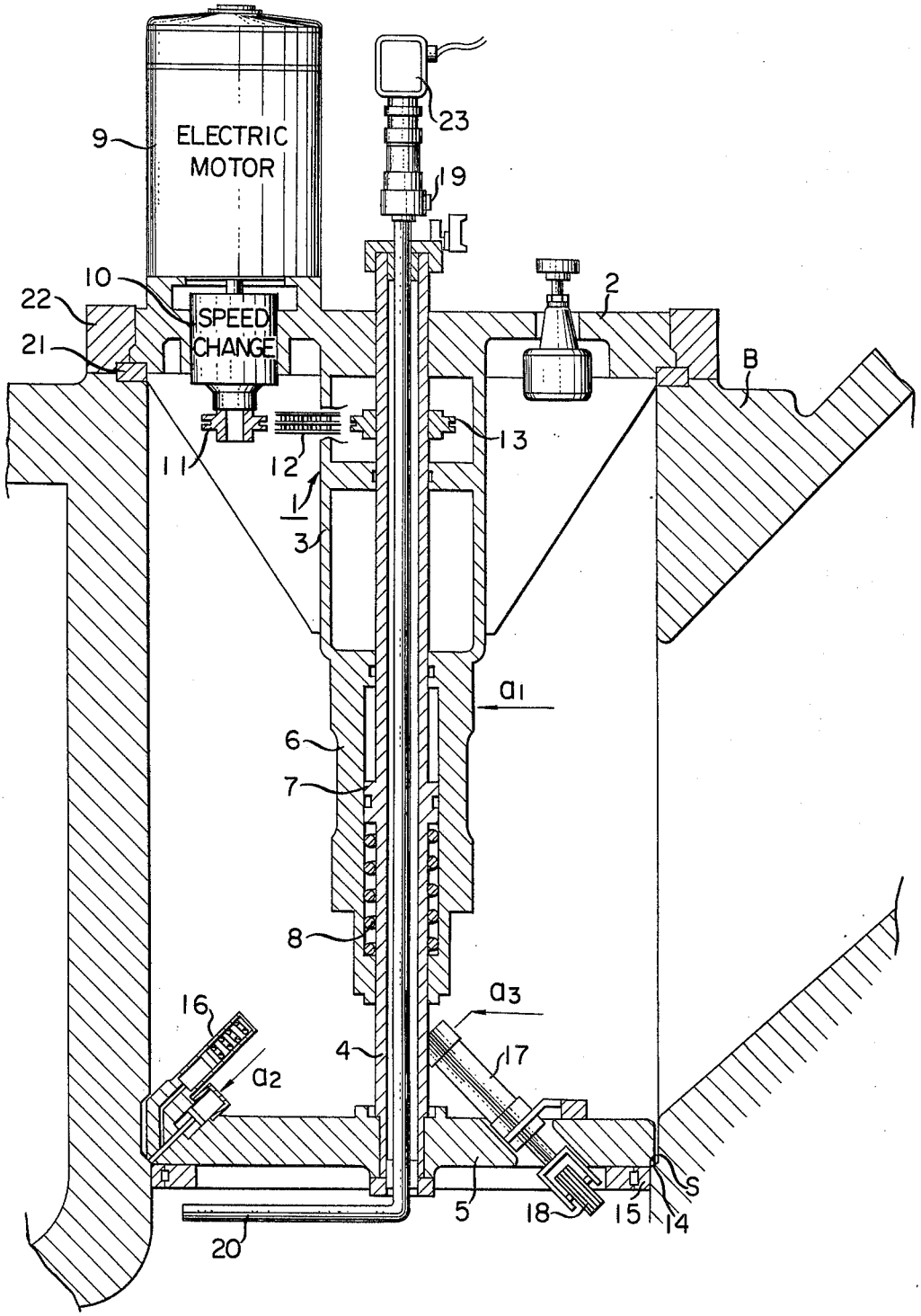
ELECTRIC
MOTOR
SPEED
CHANGE
9
10
11
12
13
1
2
3
4
5
6
7
8
14
15
16
17
18
19
20
21
22
23
B
S
a1
a2
a3

DEVICE FOR AUTOMATICALLY LAPPING VALVE SEAT

BACKGROUND OF THE INVENTION

This invention relates to a device for automatically lapping valve seats and more particularly to such a device suitable for repairing main steam valves and the like used in atmospheres highly contaminated with radioactive substances in nuclear power plants or the like.

Nuclear power plants are subject to legal periodic inspections at predetermined time intervals. Under these circumstances it is frequently required to lap valve seats upon repairing main steam isolation valves and other valves. The lapping operation has be previously necessary to be manually performed. Therefore after a radiation level within the particular nuclear reactor has been reduced to its permissible value or less, repair personnels are usually entered into that nuclear reactor to perform the operation of lapping valve seats within a time interval as short as possible. It has been previously said that a radiation dose of each operation is inversely proportional to the square of a distance from a contamination source involved and also such a radiation dose is proportional to his or her working hours. Therefore the same operator can not work for a long time and the exposure dose of the operator restricts his or her working hours. This has unavoidably led to the shift of repair personnels after short working hours in view of the control of their health and accordingly to the necessity of securing many experts.

On the other hand, devices for lapping valve seats have been previously proposed. Most of the proposed lapping device have been of the manually operated type although some of the devices have been of the power operated type. In either type of conventional lapping devices a valve seat to be lapped has been coated with a lapping agent and centered on the lapping plate. Then the lapping plate has been rotated with a predetermined rotational force and with respect to the valve seat thereby to lap the latter through the lapping agent. However those devices have been of such a structure that a pressure applied to the interface of the valve seat and lapping plate is maintained at a predetermined fixed magnitude and can be adjusted in accordance with the area of the particular valve seat and that for each cycle of the lapping operation the lapping agent is applied to the valve seat being lapped or the next valve seat after the removal of the lapping plate. It is desirable to prove a device for automatically lapping valve seats operated at a remote position. This is particularly desirable for lapping valve seats used in the nuclear reactor because jobs performed within the reactor are not desirable in view of the health of the operators.

SUMMARY OF THE INVENTION

Accordingly it is an object of the present invention to provide a new and improved device for automatically lapping valve seats which apparatus is possible to be operated at a remote position and eliminates the necessity of performing the operation within the associated nuclear reactor.

The present invention accomplishes this object by the provision of a lapping device for automatically lapping a valve seat, comprising, in combination, a supporting plate for securing the device to a valve body including a valve seat to be lapped a sleeve member pendent from the central portion of the supporting plate, a hollow driven shaft extending through both the supporting plate and the sleeve member to have one end portion slighly projecting beyond the supporting plate and the other end portion projecting beyond the sleeve member, fluid operated cylinder means disposed in the sleeve member on that side remote from the supporting plate, a piston member disposed on the driven shaft to cooperate with the cylinder means to longitudinally move the driven shaft, a lapping plate attached to the extremity of the other end portion of the driven shaft and including a peripheral edge capable of being intimately contacted by the valve seat through the longitudinal movement of the driven shaft when the supporting plate is positioned on the valve body, driving means for driving the drived shaft along with the lapping plate, and automatic supply means disposed on the lapping plate to automatically supply a lapping agent to the peripheral edge of the lapping plate.

BRIEF DESCRIPTION OF THE DRAWING

The present invention will become more readily apparent from the following detailed description taken in conjunction with the accompanying drawing in which a single FIGURE is a longitudinal sectional view, partly in elevation of a device for automatically lapping a valve seat constructed in accordance with the principles of the present invention and operatively coupled to a valve body.

DESCRIPTION OF THE PREFERRED EMBODIMENT

Referring now to the drawing, there is illustrated a device for automatically lapping valve seat constructed in accordance with the principles of the present invention which device is suitable for lapping the valve seat of the main steam isolation valve within containers having housed therein nuclear reactors high in radiation dose. The arrangement illustrated comprises a main frame generally designated by the reference numeral 1 including a supporting disc 2 and a sleeve member 3 formed integrally with the supporting disc 2 to extend from the central portion of the lower surface as viewed in the drawing of the supporting disc 2 and substantially perpendicularly to the latter. A hollow driven shaft 4 extends through the center of the supporting disc 2 and also coaxially through the sleeve member 3 and supported by both the supporting disc 2 and intermediate portions of the sleeve member 3 for both rotational movement and longitudinally sliding movement. The driven shaft 4 has one end portion slightly projecting beyond the supporting disc 2 and the other end portion projecting beyond that end remote from the supporting disc 2 or the lower end of the sleeve member 3. Then a lapping plate 5 in the form of a disc is fixedly secured to the extremity of the other end portion of the driven shaft to be substantially perpendicular to the axis of the shaft 4.

The sleeve member 3 is provided on that side remote from the supporting disc 2 with a pneumatic cylinder 6 within which a piston 7 is slidably disposed. The piston 7 is shown in the drawing as being formed of that portion of the hollow shaft 4 located within the cylinder 6 and large in diameter. The piston 7 may be formed of an annular member fitted onto and fixed to the shaft 4.

Then a compression spring 8 is disposed around the driven shaft 4 between the piston 7 and the lower end as viewed in the drawing of the cylinder 6 within the latter. The spring 8 serves normally to maintain the lapping plate 5 at a predetermined distance from the supporting disc 2 as will be described hereinafter.

In order to drive the driven shaft 4, an electric reversible motor 10 is fixedly secured to the outer or upper surface of the supporting disc 2 and operatively connected to a speed change gearing 10 disposed in that portion of the disc 2 located below the motor 9. Then the gearing 10 is operatively connected to a sprocket wheel 11 subsequently coupled by an endless chain 12 (only one portion of which is illustrated) to another sprocket wheel 13 mounted on the shaft 4. Thus motor 9 forms driving means for the driven shaft 4 along with the components 10 through 13 to transmit a torque to the shaft 4.

The lapping plate 5 has a lower peripheral edge as viewed in the drawing bevelled to form a working surface 14 complementary in configuration to the desired valve seat and a guide ring 15 detachably secured to the lower surface thereof. Further the lapping plate 5 is provided on the upper surface with supply means 16 for automatically supplying a lapping agent and a cleaning wiper 17. More specifically, the supply means 16 is composed of a syringe obliquely fixed to the peripheral portion of the lapping plate 5 to open at that portion of the lower plate 5 surface adjacent to the lower end as viewed in the drawing of the bevelled working surface 14. The cleaning wiper 17 is suitably supported to the lapping plate 5 to radially outwardly extend therethrough. The wiper 17 includes a pneumatic small-sized cylinder, a piston rod with a forked end extensible from the cylinder and a stack 18 of circular wiping laminations of fibrous material carried by the forked end of the piston rod.

As shown, a periscope type observation glass 19 coaxially extends through the hollow driven shaft 4 and has an upper end slightly projecting beyond the adjacent end of the shaft 4. The lower portion of the observation glass 19 projecting beyond the lapping plate 5 is bent in a direction substantially parallel to the lapping plate 5 and has an end 20 reaching adjacent the periphery of the plate 5.

The arrangement thus far described is shown in the drawing as being operatively connected to a valve box B including a valve seat S to be lapped with an associated valve removed from the valve body. The supporting disc 2 rests on the upper end of the valve body B. A centering ring 21 is detachably secured to the lower surface thereof. The centering ring 12 is fitted into an associated peripheral groove formed on the upper end of the valve body B with a predetermined tolerance to cause the center of the lapping plate 5 to coincide with that of the valve seat by the aid of the guide ring 15 on the lapping plate 5. Thereafter the arrangement is fixedly secured to the valve body B by means of clamping means including an annular permanent magnet 22 snugly fitted onto the supporting disc 2. Under these circumstances, the lapping plate 5 is located at its predetermined position where it is positioned short of the valve seat S. Then the lapping plate 5 can be slightly moved toward the valve seat S axially of the shaft 4 until the working surface 14 thereof engages the latter.

In order to effect this slight axial movement of the lapping plate 5, a suitable fluid under pressure such as air or nitrogen gas is introduced into the upper end of the cylinder 6 through a fluid feed mechanism as schematically shown by the arrow $a_1$ to downwardly push the piston 7 against the action of the compression spring 8. Thus the driven shaft 4 and hence the lapping plate 5 is moved downwardly until the working surface 14 of the plate 5 is brought into intimate contact with the valve seat S.

Under these circumstances, an electromagnetic valve or an adjusting valve (not shown) disposed within the fluid supply mechanism $a_1$ can be operated to control the pressure of the fluid within the cylinder 6 thereby to control a surface pressure under which the working surface 14 of the fitting plate 5 pushes against the valve seat S to any desired value.

While the lapping plate 5 pushes against the valve seat S under the required pressure as above described, the reversible motor 9 is energized to drive the driving shaft 4 and therefore the lapping plate 5 in either of the opposite directions through the speed change gearing 10, the sprocket wheel 11, the endless chain 12 and the sprocket wheel 13. At the same time a pressurized fluid is supplied to the lapping agent supply means 16 through a fluid feed mechanism as schematically shown by the arrow $a_2$ to inject a lapping agent included therein at the interface of the working surface 14 of the lapping plate 5 and the valve seat S. Thus the valve seat S is lapped by the working surface 14 while the lapping agent is supplied to the interface of the two components 14 and S.

The rotational speed of the lapping plate 5 can be changed by the operation of the speed change gearing 10. If the speed change gearing 10 can change continuously the change gear ratio thereof then the rotational speed of the lapping plate can be varied in stepless manner.

The pressurized fluid supplied to the supply means 16 may be the same as the fluid introduced into the cylinder 6 and the pressure thereof can be controlled by an electromagnetic valve or the like (not shown) disposed in the fluid feed mechanism $a_2$.

After the completion of the lapping operation or in the lapping operation, the motor 9 can be deenergized to stop the lapping plate 5 and then the driven shaft 4 with the lapping plate 5 is raised to separate the working surface 14 of the lapping plate 5 away from the valve seat S through the combined operation of the cylinder, piston and spring 6, 7 and 8 respectively. Following this a pressurized fluid is supplied to the cylinder of cleaning wiper 17 through a fluid feed mechanism as schematically shown by the arrow $a_3$ in the drawing. This causes the wiping stack 18 to push against the valve seat S. Simultaneously the lapping plate 5 is rotated through the energization of the motor 9 while a liquid cleaner is intermittently or continuously spouted on the valve seat S thereby to cause the stack 18 to wipe and clean the entire area of the valve seat S. Thereafter the wiping stack 18 is retracted to its original position.

The wiper 17 may be preferably constructed so that the wiping stack 18 is rotated through a predetermined angle, for example, one eighth of one complete rotation thereof for each complete rotation of the lapping plate 5. Also movements associated with the reciprocating movement of the wiping stack 18 may be effected by the operation of the cylinder disposed in the wiper 17.

After the completion of the lapping operation, one can observe the lapped valve seat through the observation glass 19 to determine if the lapped valve seat is acceptable. If desired, a photographic camera (not shown) may be operatively coupled to the observation glass 19 to photograph the status of a valve seat before and after the particular lapping operation. Alternatively, as shown in the drawing, a television pickup camera 23 high in resolution may be operatively connected to the upper end of the observation glass 19 for the purpose of reproducing and observing the lapped status of the particular valve seat through the associated television receiver at a remote position. The pickup camera 23 may be also operatively coupled to the observation glass 19 through a fibre optics (not shown).

From the foregoing it will be appreciated that the operation of the lapping device according to the present invention is controlled by electrical and/or pressurized fluid means. Therefore the operator can operate any suitable operation board disposed at a remote position to perform all the necessary operations required for lapping valve seats without directly touching the device. Also the operation board can be provided with a television set to always monitor the lapping operations. Therefore it is possible to avoid a danger that the operator may be exposed to radiation. Further the present invention is extremely advantageous in view of the economy because of the elimination of the necessity of performing the mannual operation requiring many shift operators. In addition, the use of magnetically clamping means permits the one-step operation of fixing the device to a valve body without performing any operation requiring to touch the components, such as bolting.

While the present invention has been illustrated and discribed in conjunction with a single preferred embodiment thereof it is to be understood that various changes and modifications may be resorted to without departing from the spirit and scope of the present invention.

What we claim is:

1. A device for automatically lapping a valve seat, comprising, in combination, a supporting plate for securing said device to a valve body including a valve seat to be lapped, a sleeve member pendent from the central portion of said supporting plate, a hollow driven shaft extending through both said supporting plate and said sleeve member to have one end portion slightly projecting beyond said supporting plate and the other end portion projecting beyond said sleeve member, fluid operated cylinder means disposed in said sleeve member on that side remote from the supporting plate, a piston member disposed on the driven shaft to cooperate with said cylinder means to longitudinally move said driven shaft, a lapping plate attached to the extremety of said other end portion of said driven shaft and including a peripheral edge capable of being intimately contacted by said valve seat through the longitudinal movement of said driven shaft when said supporting plate is positioned on said valve body, driving means for driving said driven shaft along with said lapping plate, and automatically supply means disposed on said lapping plate to automatically supply a lapping agent to said peripheral edge of said lapping plate.

2. An automatically lapping device as claimed in claim 1, wherein said lapping plate is provided with a cleaning wiper including a wiping member in the form of a ring capable of engaging said valve seat.

3. An automatically lapping device as claimed in claim 1, wherein a periscope type observation glass extends through said hollow driven shaft.

4. An automatically lapping device as claimed in claim 1. wherein said supporting plate is fixed to said valve body by means of magnet type clamping means.

* * * * *